US007437789B2

(12) United States Patent
Thompson

(10) Patent No.: US 7,437,789 B2
(45) **Date of Patent: *Oct. 21, 2008**

(54) LUMBAR BACK SUPPORT DEVICE

(76) Inventor: Harlyn J. Thompson, 1322 SE. Knapp St., Portland, OR (US) 97202

( * ) Notice: Subject to any disclaimer, the term of this patent is extended or adjusted under 35 U.S.C. 154(b) by 0 days.

This patent is subject to a terminal disclaimer.

(21) Appl. No.: 11/448,163

(22) Filed: Jun. 5, 2006

(65) Prior Publication Data

US 2007/0039102 A1 Feb. 22, 2007

Related U.S. Application Data

(63) Continuation-in-part of application No. 10/424,087, filed on Apr. 25, 2003, now Pat. No. 7,055,199.

(51) Int. Cl.
*A61F 5/34* (2006.01)

(52) U.S. Cl. ..... 5/655.3; 5/626; 5/644

(58) Field of Classification Search ..... 5/655.3, 5/644, 708

See application file for complete search history.

(56) References Cited

U.S. PATENT DOCUMENTS 2,077,233 A * 4/1937 Greenhill ..... 5/655.3
4,207,633 A * 6/1980 Smith et al. ..... 5/632
4,516,568 A * 5/1985 Baxter et al. ..... 5/630
4,669,455 A * 6/1987 Bellati ..... 5/655.3
5,201,761 A * 4/1993 Serola ..... 5/633
5,711,575 A * 1/1998 Hand et al. ..... 297/284.6
5,713,841 A * 2/1998 Graham ..... 5/632
5,785,669 A * 7/1998 Proctor et al. ..... 5/655.3
5,902,011 A * 5/1999 Hand et al. ..... 5/655.3
5,948,013 A * 9/1999 Swezey et al. ..... 5/636
D419,495 S * 1/2000 Muhanna ..... 5/710
6,138,306 A * 10/2000 Muhanna ..... 5/706
6,357,066 B1 * 3/2002 Pierce ..... 5/710
6,385,802 B1 * 5/2002 Roberts et al. ..... 5/621
6,427,697 B1 * 8/2002 Pearcey ..... 128/876
6,468,205 B1 * 10/2002 Mollenauer et al. ..... 600/201
7,055,199 B2 * 6/2006 Thompson ..... 5/655.3

* cited by examiner

*Primary Examiner*—Frederick L. Lagman
(74) *Attorney, Agent, or Firm*—Kolisch Hartwell, P.C.

(57) ABSTRACT

A lumbar support pillow for supporting the lumbar spine of a person. The support pillow includes a fillable elongate first chamber longitudinally configured to engage and support the person along the longitudinal axis of the person's lumbar spine in a manner substantially conforming to the natural curvature of the spine when filled. The pillow also includes a second chamber that extends downwardly and away from the first chamber on both sides of the first chamber; is independent of the first chamber, and is configured to engage and support the person in a region laterally adjacent to the person's lumbar spine.

21 Claims, 9 Drawing Sheets

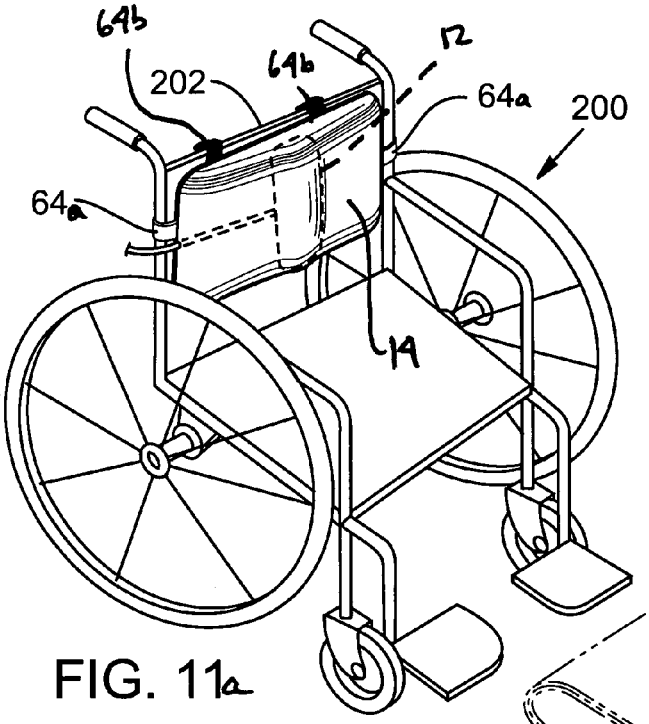
FIG. 11a
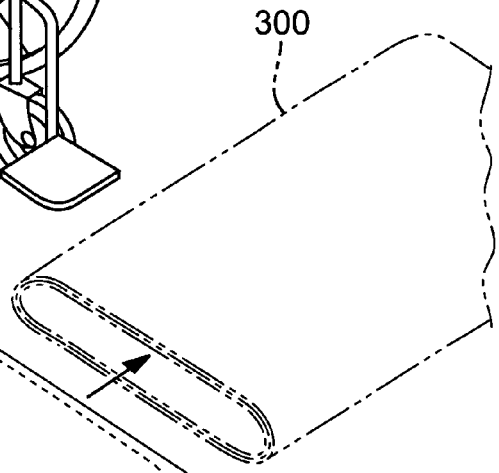
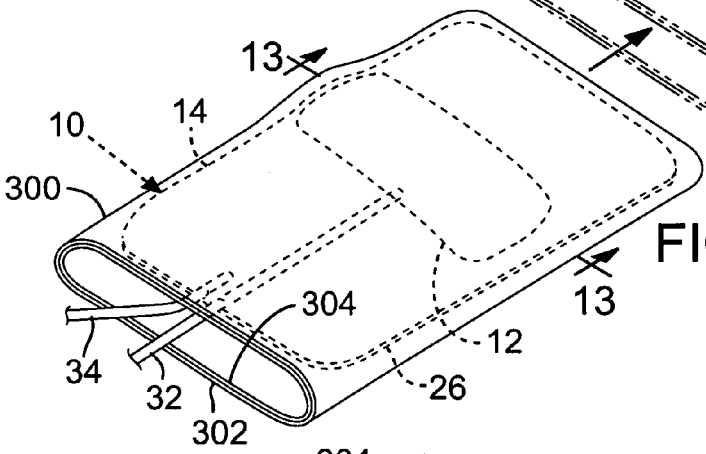
FIG. 12
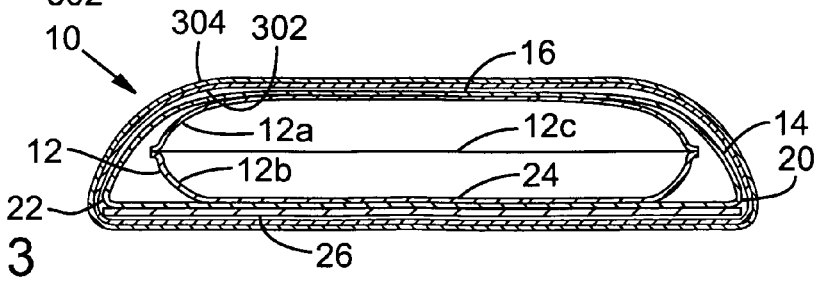
FIG. 13

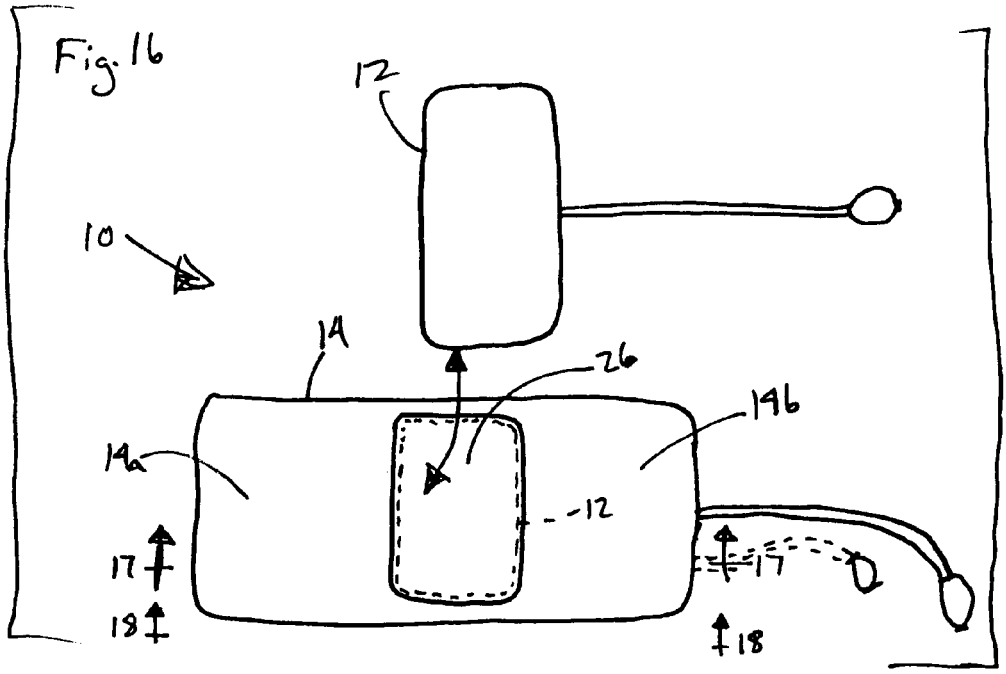
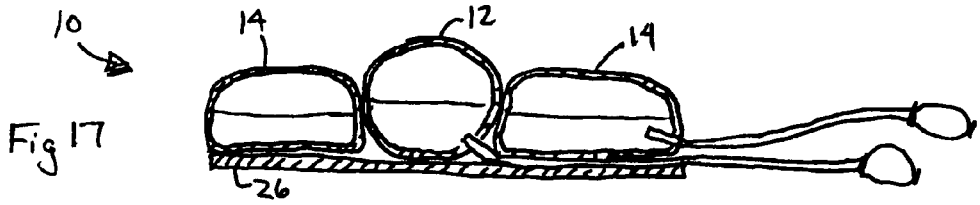
Fig 17
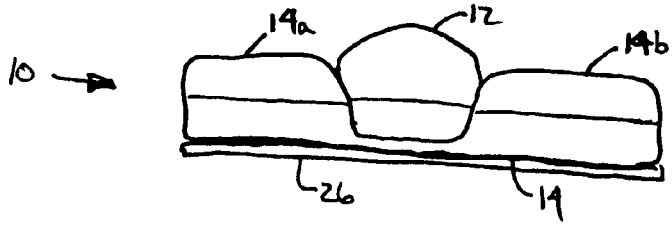
Fig. 18
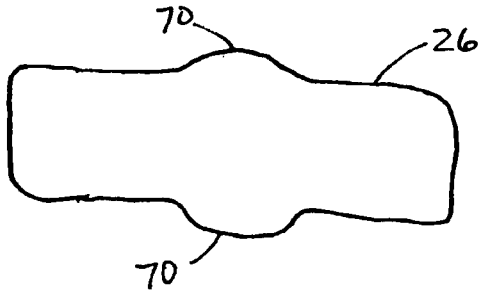
Fig. 19

LUMBAR BACK SUPPORT DEVICE

CROSS-REFERENCE TO RELATED APPLICATION

This application is a continuation-in-part application of Ser. No. 10/424,087 filed Apr. 25, 2003, which issued on Jun. 6, 2006, as U.S. Pat. No. 7,055,199, and is incorporated herein by reference in its entirety.

FIELD OF THE INVENTION

The present invention relates generally to medical appliances, and more particularly to a lumbar support device for reducing lower back pain by supporting the lumbar region of a person's spine with an adjustable support pillow.

BACKGROUND OF THE INVENTION

In its position of natural homeostasis, the lower, or lumbar, region of the human spine is curved towards the front of the body (lordotic) when viewed from the side. When the lumbar region of the spine becomes curved away from this position of natural homeostasis, the resulting condition is generally termed lumbar lordosis, or hyperlordosis in cases of extreme curvature. One situation that may lead to departure from natural homeostasis in the lower back occurs when a person is required to maintain a relatively fixed lumbar position for a long period of time. For example, maintaining a seated, sloped, or supine position may force the lumbar region away from its natural lordotic curvature, leading to pain and/or limited movement.

There are numerous situations in which a person may be required to maintain a non-homeostatic lower back position. For example, patients recovering from surgery and/or undergoing medical procedures may have to remain in a supine position for a relatively long period of time, with little or no movement. Such medical procedures include cardiac catherization (angiogram), magnetic resonance imagery (MRI), echocardiogram (ECG), renal scanning, and various other imaging and/or testing procedures. In some cases, these procedures may require patients to lie completely still for 4-6 hours or more.

Additionally, women undergoing prolonged labor during childbirth, patients who have received external fixation to facilitate healing of broken bones, burn patients, victims being examined and/or transported after an accident, terminally ill patients, and permanently disabled patients, among others, may also be required to maintain a sloped or horizontal supine position for long periods of varying duration. During this time, patients may suffer considerable back pain, particularly in the lumbar region.

Perhaps even more commonly, a person sitting in a wheelchair, an office chair, an automobile seat, or an airplane seat may spend hours at a time in a relatively fixed position, with their lower back forced away from its natural lordotic curvature. Often, this leads to lumbar back pain and/or restricted range of movement. Prolonged maintenance of an anatomically incorrect posture while either supine or seated may lead to long-term misalignment of the spine, which often requires medical attention and which in some instances may not be easily reversible.

To ameliorate the back pain described above, drugs such as narcotic painkillers may be administered or taken. These drugs often are addictive, they typically decrease productivity in the workplace, and they may be unsafe when taken by a driver of a car or by an operator of machinery. Furthermore, narcotic painkillers may have numerous adverse medical side effects, including nausea, vomiting, low blood pressure, itching, confusion, accelerated heart rate, and constipation, among others.

An alternative to administering drugs is to attempt to mechanically provide lower back support, for example by pushing conventional pillows, towels, and the like behind or beneath the lower back. However, this action may require undesirable movement on the part of the user, and can interfere with medical testing procedures in cases where the user is a clinical patient. Furthermore, such mechanical means may not be designed to support the lumbar spine in an anatomically correct position. Therefore, existing mechanical measures may not result in substantial added comfort for the user, and in some instances may even exacerbate a medical condition.

In light of the above considerations, a need exists for a noninvasive, convenient, and comfortable device for supporting the lumbar spine of a person in a seated, sloped, or supine position.

BRIEF DESCRIPTION OF THE DRAWINGS

FIG. 11*a* is a perspective view of a lumbar support pillow attached to a wheelchair with a strap according to an embodiment of the invention.

FIG. 12 is a perspective view of a lumbar support pillow with a removable cover.

FIG. 13 is a side cross sectional view of an embodiment of the lumbar support pillow shown in FIG. 12, taken along lines 13-13.

FIG. 16 is a top view of another embodiment of a lumbar support pillow.

FIG. 17 is a cross-sectional view of the lumbar support pillow of FIG. 16.

FIG. 18 is another cross-sectional view of the lumbar support pillow of FIG. 16.

FIG. 19 is a top view of a base having an oblong shape.

DETAILED DESCRIPTION OF THE PREFERRED EMBODIMENT

Figure 1:
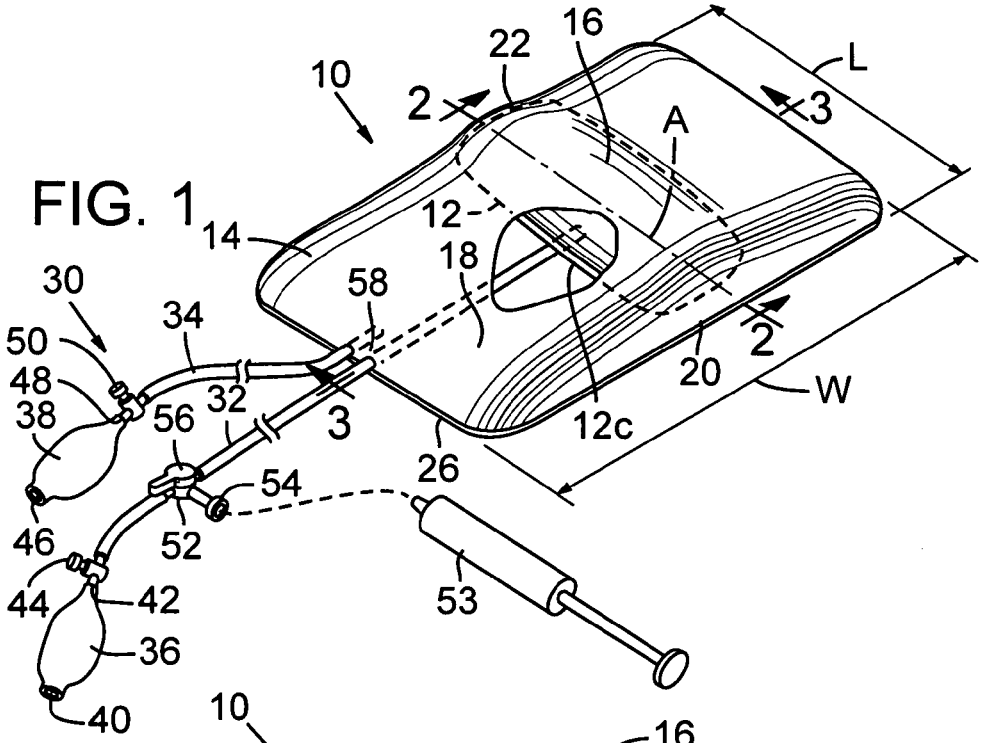
FIG. 1 is a perspective view of an embodiment of a lumbar support pillow.
Figure 2A:
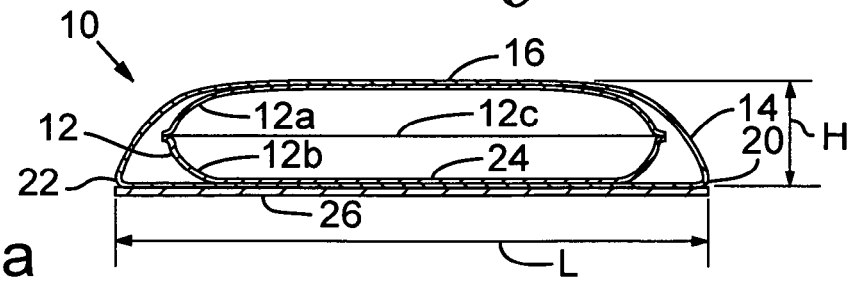
FIG. 2*a* is a side cross sectional view of the lumbar support pillow shown in FIG. 1, taken along lines 2-2.

FIGS. 1 and 2*a* show an embodiment of a lumbar support pillow, generally indicated at 10. Support pillow 10 includes a fillable central or spine support chamber 12, and a fillable lateral chamber 14. Both chambers 12 and 14 shown in FIGS. 1 and 2*a* may be filled with a fluid such as a gas, a liquid, and/or a gel, in a manner described in detail below. Both chambers are depicted in FIGS. 1 and 2*a* as substantially filled with fluid.

Central chamber 12 is longitudinally configured to engage and support a person along the longitudinal axis of the person's spine. As shown in FIG. 1, central chamber 12 is an elongate chamber having a longitudinal axis A. When central chamber 12 is at least partially filled, it defines a contoured support surface 16 near the center of the support pillow. Support surface 16, as defined by the central chamber 12, is dimensioned to engage a person along the longitudinal axis of the person's lumbar spine, thereby supporting the lumbar region in a position of relative homeostasis.

FIG. 2*a* shows a side cross sectional view of the lumbar support pillow shown in FIG. 1, taken along lines 2-2. As illustrated, support surface 16 may be generally arcuate in shape when at least partially filled, thereby providing a substantially smooth interface for engaging and supporting the person's lumbar spine. Support surface 16 may thus have a height H that varies symmetrically along its length L. In other words, the height H of the support surface may be substantially the same at any particular longitudinal distance inward from edge 20 of the lateral chamber, as its height H at the same longitudinal distance inward from edge 22 of the lateral chamber.

As shown in FIG. 1, lateral chamber 14 extends laterally on both sides of the central chamber 12, and is configured to provide expanses that engage and support a person in a region laterally adjacent to the person's lumbar spine. As illustrated, an upper surface 18 of lateral chamber 14 curves downwardly and away from central chamber 12 when at least partially filled. The lateral chamber 14 thus provides additional lumbar support to the region laterally adjacent to the person's lumbar spine, and enhances the rotational stability of a supine person lying on top of support pillow 10.

In some embodiments, such as the embodiment shown in FIGS. 1 and 2*a* amongst others shown in the drawings, central chamber 12 and lateral chamber 14 are both selectively fillable with fluid. In these embodiments, central chamber 12 may be filled with varying amounts of fluid, so as to allow a person to vary the curvature of support surface 16 and/or the degree of lumbar support provided by central chamber 12 along the longitudinal axis of the person's lumbar spine. Likewise, lateral chamber 14 may be filled with varying amounts of fluid, so as to allow a person to vary the curvature of upper surface 18 and/or the degree of lumbar support provided by lateral chamber 14 to the region laterally adjacent to the person's lumbar spine. As discussed below, in some embodiments, one or both of the central chamber or the lateral chamber may not be selectively fillable with fluid, but instead may be filled with a padding material.

In some embodiments, such as the embodiment shown in FIGS. 1 and 2*a* amongst others shown in the drawings, central chamber 12 and lateral chamber 14 are independent of one another. Lumbar support pillows with independent chambers allow a user to selectively vary the degree of lumbar support imparted by a chosen one of the independent chambers, provided that the chosen chamber is selectively fillable with a fluid. These embodiments are advantageous, because each user has a slightly different same curvature in their lumbar regions, and because the fillable portions of the pillow may be varied to tailor the dimensions of the support pillow to account for differences in curvature. For example, in embodiments having a fillable central chamber 12 that is independent of the lateral chamber 14, a user may selectively vary the degree to which the central chamber is filled without changing the relative degree to which the lateral chamber is filled. The user can thereby adjust the support provided along the longitudinal axis of the lumbar spine, without substantially affecting the degree of support provided to the region laterally adjacent to the lumbar spine. Likewise, in embodiments having a fillable lateral chamber 14 that is independent of the central chamber, a user may selectively vary the degree to which the lateral chamber is filled without changing the relative degree to which the central chamber is filled. The user can thereby adjust the support provided to the region laterally adjacent to the lumbar spine, without affecting the degree of support provided along the longitudinal axis of the lumbar spine.

In some embodiments, such as the embodiment shown in FIGS. 1 and 2*a* amongst others shown in the drawings, central chamber 12 may be substantially enclosed by lateral chamber 14. This manner of construction may add to the comfort and durability of the support pillow by, for example, eliminating unnecessary external seams and/or gaps between the fillable chambers. As indicated, in such cases central chamber 12 may be nominally disposed near the center of lateral chamber 14, and may longitudinally extend to a relatively short distance from front edge 20 and rear edge 22 of the lateral chamber. For example, the central chamber may extend to within approximately ½" from edges 20 and 22 of the lateral chamber. The spacing of the central chamber away from edges 20 and 22 of the lateral chamber enables expansion of the central chamber within the lateral chamber when the central chamber is inflated or filled with fluid. In some embodiments, it may be desirable to provide a central chamber that is not enclosed by the lateral chamber, in which cases the central chamber may extend up to, or beyond, the edges of the lateral chamber.

In some embodiments, such as the embodiment shown in FIGS. 1 and 2*a* amongst others shown in the drawings, a bottom surface 24 of central chamber 12 may be attached to the inside of lateral chamber 14 by, for example, heat sealing or gluing, although any means that securely bonds bottom surface 24 to the lateral chamber may be suitable. The attachment of the two chambers helps to preserve their relative orientation, by keeping the central chamber disposed at or near the center of the lateral chamber. It should be appreciated, however, that other means of maintaining this orientation are possible, such as placing central chamber 12 and lateral chamber 14 in a case or other device that restricts their relative movement.

Figure 2B:
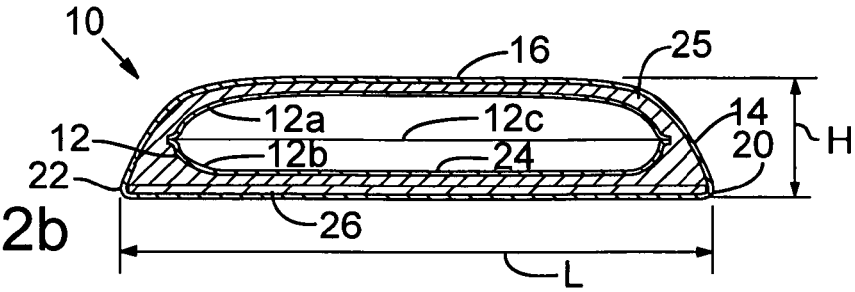
FIG. 2*b* is a side cross sectional view of another embodiment of a lumbar support pillow.

In some embodiments, in addition to or instead of being fillable with a fluid, central chamber 12 and/or lateral chamber 14 may be partially or completely filled with a padding material. For example, FIG. 2*b* shows an embodiment of a lumbar support pillow having a central chamber 12 that is selectively fillable with a fluid, and a lateral chamber 14 that is not selectively fillable with a fluid but that rather is substantially filled with a padding material 25. In embodiments where the lateral chamber is at least partially filled with a padding material, and further where the central chamber is substantially enclosed by the lateral chamber, the central chamber may be (i) positioned adjacent to the padding material, or (ii) at least partially embedded within, or enclosed by the padding material. For example, FIG. 2*b* shows the central chamber 12 enclosed by the lateral chamber 14, and completely embedded within or enclosed by the padding material 25. The padding material may provide superior comfort than a pillow filled with certain fluids, may be easier to manufacture, and may be easier to maintain. Padding material may include foam, batting, liquid(s), and/or any other suitable material.

Generally, central chamber 12 and lateral chamber 14 may be constructed from any suitable material, including but not limited to synthetic polymer materials. Suitable materials may include synthetic rubbers such as butyl rubber, neoprene, polybutadiene, latex, canvas, and the like, as well as combinations of these materials in a layered or interwoven structure. In some embodiments portions of the chambers may be attached to one another by heat sealing, gluing, or any other suitable means. For example, in the embodiment shown in FIGS. 1 and 2*a* amongst others shown in the drawings, central chamber 12 may include a top portion 12*a*, and a bottom portion 12*b* heat sealed to one another along seam 12*c*. Any selectively fillable chamber of the support pillow may be constructed from materials that are substantially impermeable to the fluids that may be used to fill them, which may include gases, liquids, and/or gels, among others.

Figure 2C:
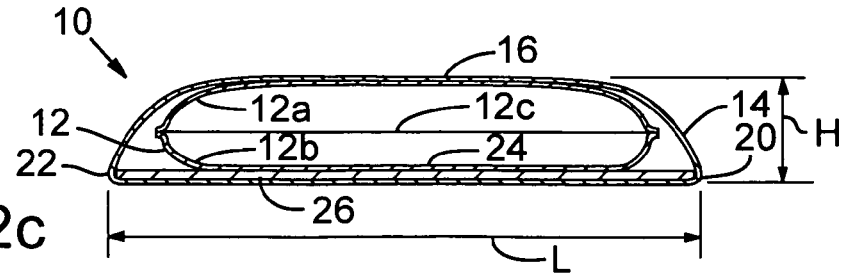
FIG. 2*c* is a side cross sectional view of yet another embodiment of a lumbar support pillow.

In some embodiments, such as the embodiment shown in FIGS. 1 and 2*a*, the support pillow may include a base member 26, preferably formed of a rigid material having a substantially flat bottom surface, to support central chamber 12 and lateral chamber 14 and to allow pillow 10 to slide between a supine patient and a horizontal surface with minimal friction. The corners of the base member may be provided with rounded corners as shown in FIG. 1, to reduce the possibility of an edge of the base member accidentally tearing fabric or injuring a person handling or using the support pillow. The base member may be constructed from a relatively low-friction, thermoplastic polymer, such as a polypropylene or polyethylene plastic material. In general, any suitable, relatively rigid material may be used in the construction of the base member that facilitates supporting the fillable chambers and/or sliding the support pillow behind or beneath a person's lower back. In some embodiments, such as those shown in FIGS. 2*b* and 2*c*, the base member 26 may be substantially enclosed by the lateral chamber 14.

In embodiments having a base member 26, the central chamber 12 and/or lateral chamber 14 may be secured to the base member with glue, a seal, or any other suitable connecting means. For example, in embodiments where the base member 26 is connected to the outside of lateral chamber 14, the lateral chamber may include a connecting seal around its lower periphery that attaches the lateral chamber firmly to the base member, or may be adhered to the base member with an adhesive. In embodiments where both the base member 26 and the central chamber 12 are substantially enclosed by the lateral chamber 14, the bottom surface 24 of central chamber 12 may be glued directly to the base member 26.

As shown in FIG. 1, support pillow 10 may include a fluid delivery mechanism, as generally indicated at 30. The fluid delivery mechanism may include one or more fluid communication channels, such as flexible tubes 32 and 34, which are each configured to deliver fluid from a fluid source to a fillable chamber. For example, in embodiments having an independent fillable central chamber 12 and an independent fillable lateral chamber 14, such as the embodiment shown in FIG. 1, a tube 32 may be configured to deliver fluid to the central chamber, and a tube 34 may be configured to deliver fluid to the lateral chamber. In some embodiments, a single tube may deliver fluid to each of two independent fillable chambers if, for example, the tube is (a) perforated to simultaneously communicate fluid to each chamber, or (b) connected to two separate tubes that simultaneously communicate fluid into each chamber. Finally, for embodiments having only a single fillable chamber, such as fillable central chamber 12 in FIG. 2*b*, a single tube may be used to deliver fluid from a fluid source to that chamber.

In some embodiments, fluid may be delivered through a tube and into a corresponding fillable chamber by actuating a depressible bulb. For example, in the embodiment shown in FIG. 1, bulb 36 is attached to tube 32, and bulb 38 is attached to tube 34, so that the corresponding fillable chambers (i.e. central chamber 12 and lateral chamber 14, respectively) are independently filled through selective use of each bulb. Each bulb may be a standard bulb of a type known to medical practitioners. For example, each bulb may be similar to bulbs used for sphygmomanometers (i.e. blood pressure measuring devices), or other similar devices. Each bulb may be constructed from an elastic material, such as rubber or a synthetic polymer material, that is substantially impermeable to the fluid used in the support pillow. In embodiments having multiple bulbs, each bulb may be a different size and/or color to enable a user to differentiate the bulbs from one other.

Depressible bulbs, such as bulbs 36 and 38, may be equipped with one or more valves to selectively permit ingress and egress of fluid into and out of the corresponding fillable chambers to which they are attached. For example, each bulb and its associated valves may be configured (a) to permit fluid to be drawn into the bulb from an external source, (b) to deliver fluid to a corresponding fillable chamber through a fluid communication channel, and/or (c) to selectively release fluid from the filled chamber. The various bulbs and valves thus allow a user to control the amount and pressure of fluid within a fillable chamber, as well as the curvature of the chamber. Specific examples of valves are described below.

Some bulbs may have a one-way valve located near its distal end, and another one-way valve located near its proximal end. For example, in the embodiment shown in FIG. 1, valve 40 permits inflow of fluid through the distal end of bulb 36, but restricts outflow from the bulb. If bulb 36 is compressed and released, a partial vacuum formed within the bulb causes fluid to be drawn into the bulb through valve 40. In contrast, valve 42 restricts inflow of fluid into bulb 36, but permits outflow of fluid through the proximal end of the bulb 36. Therefore, when bulb 36 is compressed, fluid within the bulb exits through valve 42 (but not through valve 40), and passes to its corresponding tillable chamber through a fluid communication channel (i.e. to central chamber 12 via tube 32). However, passage of fluid from the chamber 12 back to bulb 36 may be restricted by the one-way nature of valve 42. In this manner, bulb 36 may be repeatedly compressed to fill chamber 12 of the lumbar support pillow with any desired amount of fluid.

Some bulbs may also have an egress valve located near its proximal end, configured to selectively permit egress of fluid from a corresponding fillable chamber. For example, in the embodiment shown in FIG. 1, egress valve 44, which is preferably located between valve 42 and central chamber 12, permits egress of fluid from central chamber 12 without being restricted by valve 42. Therefore, upon opening egress valve 44, fluid may pass out of the central chamber 12, through tube 32, and through the egress valve. In other words, egress valves, such as valve 44, may be used to selectively deflate a corresponding fillable chamber. Egress valves may have a push-button design to facilitate one-handed operation, although other designs, such as a rotating valve head, may be suitable.

In embodiments having multiple bulbs, such as the embodiment shown in FIG. 1, each bulb may be equipped with similar valves. For example, bulb 38 shown in FIG. 1 may be equipped with valves in a manner analogous to the configuration of bulb 36. Thus, bulb 38 may include a pair of one-way valves 46 and 48 to facilitate passage of fluid to lateral chamber 14, and an egress valve 50 to selectively permit egress of fluid from lateral chamber 14. Valves 46, 48, and 50 may be similar in design and construction to valves 40, 42, and 44, including a push-button or other convenient design for egress valve 50.

Some fluid delivery mechanisms may include one or more valves for injecting fluid into a corresponding chamber with a syringe. For example, in the embodiment shown in FIG. 1, fluid delivery mechanism 30 may include a valve 52 disposed along flexible tube 32, for injecting fluid into central chamber 12 with a syringe 53. Valve 52 may be compatible with a syringe in a manner familiar to those skilled in the art of intravenous injections; for example, valve 52 may include a syringe port 54 configured to selectively receive fluid from a syringe, and a stopcock mechanism 56 for adjusting the fluid communication path allowed by the valve. In the position shown in FIG. 1, the stopcock mechanism allows fluid communication between bulb 36 and central chamber 12, and in another position (not shown) it allows fluid communication between the syringe and the central chamber. Thus, bulb 36 and syringe port 54 may be used interchangeably in conjunction with valve 52, to supply fluid to the central chamber. In some embodiments, a similar valve and stopcock mechanism may be used to selectively deliver fluid to lateral chamber 14 as well. In some embodiments, other fluid delivery mechanisms, such as pumps, may be used to deliver fluids rather than a syringe. In these embodiments, the pumps include mechanisms for delivering fluid having a regulated temperature or pressure. In such a manner, the fluid delivery mechanisms may provide heat or pressure therapy to a patient's lumbar region.

Some fluid delivery mechanisms may include a valve for directing fluid gel from a pouch into a lateral chamber. For example, referring to the embodiment shown in FIG. 1, an additional valve (not shown) may be disposed along tube 32, near an entry region 58, where the tubes enter the lateral chamber. The additional valve may be similar in construction to valve 52, including an entry port and a stopcock mechanism, but it may be configured to receive a fluid gel that may be squeezed from a pouch. For example, a glycerine-based gel or a cellulose-based gel may be used to fill central chamber 12 in this manner. Such a non-toxic fluid gel may be safely cooled in a household freezer and/or heated in a household microwave oven, allowing for convenient adjustments to the temperature of the gel prior to insertion in the lumbar support pillow.

Some fluid delivery mechanisms may include a specialized pump for pumping fluid into a corresponding fillable chamber. For example, in the embodiment shown in FIG. 1, a mechanized pump (not shown), such as an electrically powered pneumatic compression pump, may deliver fluid to one or both of chambers 12 and 14. Similar pumps are commonly used in medical devices designed, for example, to promote post-operative blood circulation. Such a mechanized pump may be configured to supply a fluid, such as air, to the lumbar support pillow in an automated fashion. For example, the mechanized pump may be equipped with a pressure sensor, and may be configured to supply fluid to the lateral and/or central chamber up to a pressure that may be preset by a user. The mechanized pump may be further configured to supply fluid periodically, in a pulsating manner that may have a massaging or similarly therapeutic effect on a user's lower back.

Tubes associated with the fluid delivery mechanism are generally configured and positioned for comfort, accessibility, and functionality. The tubes may enter the lumbar support pillow at an entry region that is positioned laterally away from the central chamber, and/or that is substantially centered along the length of the lateral chamber, such that a person using the lumbar support pillow is not required to lie on portions of the tube disposed outside of the support pillow. Each tube may be configured to have a length that enables a person to use the bulbs when the pillow is in use, and/or to differentiate between tubes. Each tube may also have a diameter that provides a suitable flow of fluid to the fillable chambers, but that is not too wide that a person feels a substantial lump when using the pillow. For example, in the embodiment shown in FIG. 1, tubes 32 and 34 enter the fillable chambers at entry region 58, which is centered along the length L of the lateral chamber 14. Placement of the tubes at entry region 58 may allow both right-handed and left-handed users to have equally convenient access to the bulbs and egress valves, by rotating the support pillow to position the entry region on the dominant side of the person's body. Tube 32 may be approximately 22" long, and tube 34 may be approximately 24" long, although other lengths may be suitable for allowing a user and/or an attendant to access and/or easily distinguish the tubes from one other. Each tube may have an inner diameter of approximately 3/16" and an outer diameter of approximately 5/16", although other diameters may be appropriate in some embodiments. In general, any configuration is suitable that allows a user and/or an attendant to conveniently adjust the fluid pressure in the fillable chambers. Preferably, the adjustment may be made without requiring significant motion of the user.

The dimensions of the support pillow and its components generally may be chosen to facilitate their comfort and convenient use, and it may be desirable to provide several sizes of support pillows so that the most appropriate size may be chosen for a given application. Specifically, it may be desirable to provide sizes suitable for use by people of varying heights and/or weights. The charts below provide nonexclusive examples of possible approximate dimensions of the central chamber, the lateral chamber, and the base member in various embodiments.

In the charts, "Length L" refers to the direction parallel to the longitudinal axis of the central chamber, "Width W" refers to the direction perpendicular to the length and in the plane of the base member, and "Height H" refers to the direction orthogonal to the plane of the base member. As an example, the length, width, and height of lateral chamber 14 are indicated as "L", "W", and "H", respectively, in FIGS. 1 and 2. In general, the heights of the fillable chambers refer to their approximate heights when substantially filled with fluid.

Size A (short)

| | Central chamber 12 | Lateral chamber 14 | Base member 26 |
|---|---|---|---|
| Length L | 5" | 6" | 6" |
| Width W | 2" | 12" | 12" |
| Height H | 2" | 2" | 0.125" |

Size AA (short/obese)

| | Central chamber 12 | Lateral chamber 14 | Base member 26 |
|---|---|---|---|
| Length L | 5" | 6" | 6" |
| Width W | 3" | 16" | 16" |
| Height H | 3" | 3" | 0.125" |

Size AAA (short/morbidly obese)

| | Central chamber 12 | Lateral chamber 14 | Base member 26 |
|---|---|---|---|
| Length L | 5" | 6" | 6" |
| Width W | 4" | 20" | 20" |
| Height H | 4" | 4" | 0.125" |

Size B (medium height)

| | Central chamber 12 | Lateral chamber 14 | Base member 26 |
|---|---|---|---|
| Length L | 6" | 7" | 7" |
| Width W | 2.5" | 14" | 14" |
| Height H | 2.5" | 2.5" | 0.125" |

Size BB (medium height/obese)

| | Central chamber 12 | Lateral chamber 14 | Base member 26 |
|---|---|---|---|
| Length L | 6" | 7" | 7" |
| Width W | 3" | 18" | 18" |
| Height H | 3" | 3" | 0.125" |

Size BBB (medium height/morbidly obese)

| | Central chamber 12 | Lateral chamber 14 | Base member 26 |
|---|---|---|---|
| Length L | 6" | 7" | 7" |
| Width W | 4" | 22" | 22" |
| Height H | 4" | 4" | 0.125" |

Size C (tall)

| | Central chamber 12 | Lateral chamber 14 | Base member 26 |
|---|---|---|---|
| Length L | 8" | 9" | 9" |
| Width W | 3" | 17" | 17" |
| Height H | 3" | 3" | 0.125" |

Size CC (tall/obese)

| | Central chamber 12 | Lateral chamber 14 | Base member 26 |
|---|---|---|---|
| Length L | 8" | 9" | 9" |
| Width W | 4" | 20" | 20" |
| Height H | 4" | 4" | 0.125" |

Size CCC (tall/morbidly obese)

| | Central chamber 12 | Lateral chamber 14 | Base member 26 |
|---|---|---|---|
| Length L | 8" | 9" | 9" |
| Width W | 5" | 24" | 24" |
| Height H | 5" | 5" | 0.125" |

Figure 3A:
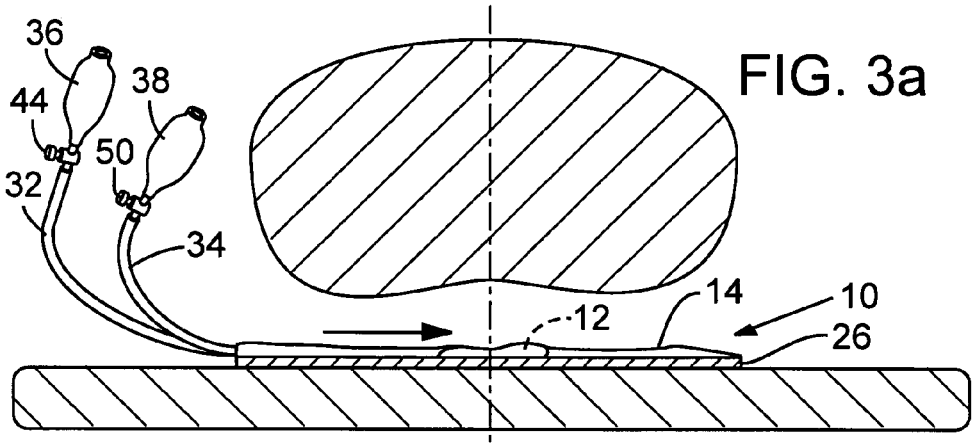
FIG. 3*a* is a front cross sectional view of the lumbar support pillow of FIG. 1 taken along lines 3-3, where the chambers of the pillow are shown uninflated, and the pillow is shown sliding beneath a supine person on a horizontal surface.

FIG. 3*a* is a front cross sectional view of the lumbar support pillow 10 of FIG. 1, taken along lines 3-3, shown sliding under a supine person, prior to filling chambers 12 and 14. As depicted in FIG. 3*a*, the support pillow may be constructed to lie substantially flat before the chambers are filled, facilitating its placement under the back of a supine person. Substantially rigid construction of base member 26 may further allow the support pillow to slide under a supine person with little or no movement of the person. This may, for example, permit the pillow to be positioned under a person undergoing a medical testing procedure without interrupting the procedure.

Figure 3B:
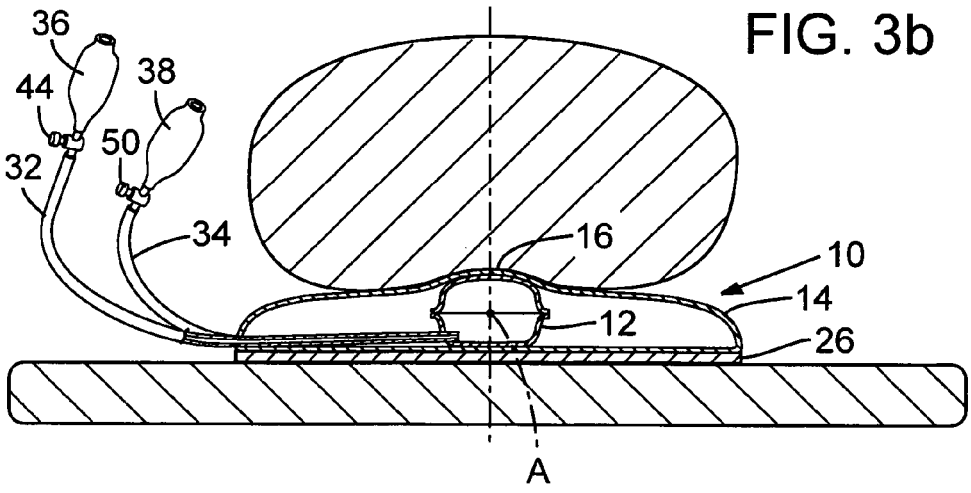
FIG. 3*b* is another front cross sectional view of the lumbar support pillow of FIG. 1 taken along lines 3-3, where the chambers of the pillow have been inflated to support the lumbar region of the supine person.

FIG. 3*b* is a front cross sectional view of the lumbar support pillow 10 of FIG. 1, taken along lines 3-3, after chambers 12 and 14 have been at least partially filled with fluid. As shown, the longitudinal axis A of central chamber 12 is positioned parallel to the longitudinal axis of the person's spine, such that support surface 16 is engaged with and supporting a supine person's lumbar spine along its longitudinal axis, and lateral chamber 14 is engaged with and supporting the person in a region laterally adjacent to the person's lumbar spine.

Figure 4A:
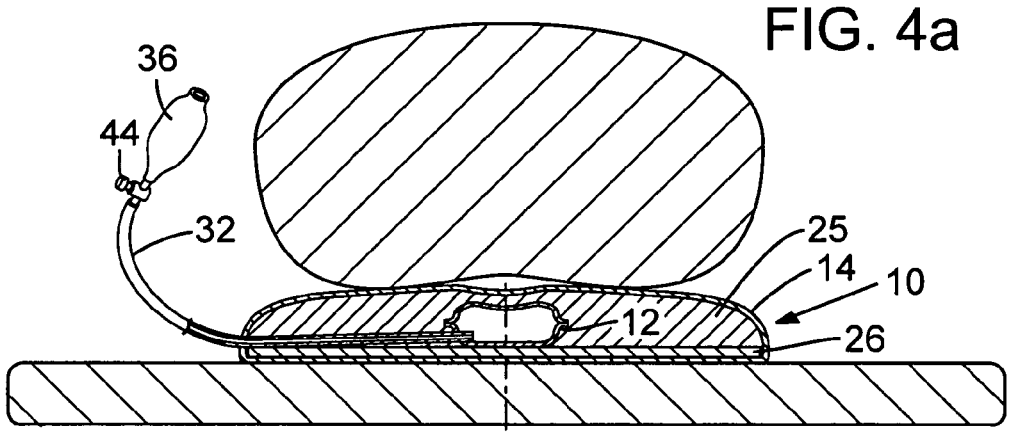
FIG. 4*a* is a front cross sectional view of the lumbar support pillow of FIG. 2*b*, where the central chamber is shown uninflated and the pillow is shown positioned beneath a supine person on a horizontal surface.
Figure 4B:
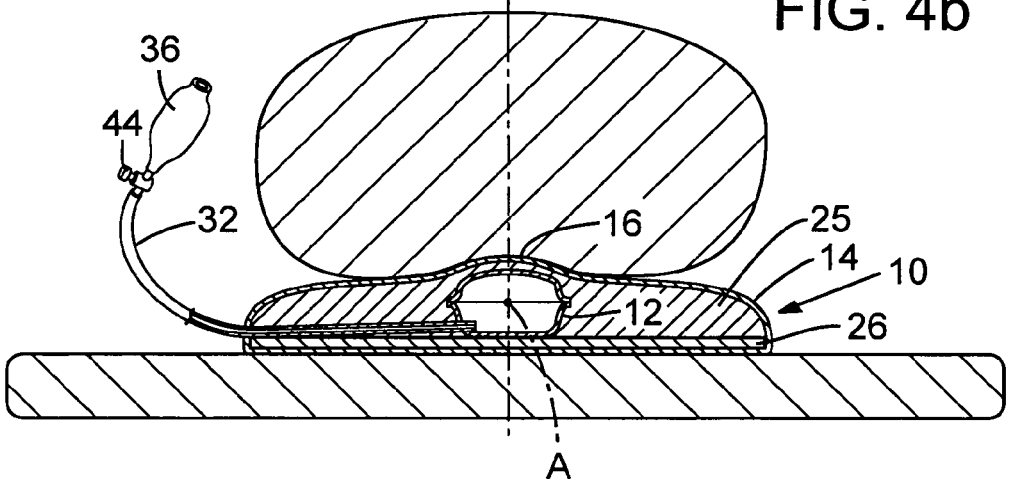
FIG. 4*b* is another front cross sectional view of the lumbar support pillow of FIG. 2*b*, where the pillow has been inflated to support the lumbar region of the supine person.

FIG. 4*a* is a front cross sectional view of the lumbar support pillow of FIG. 2*b*, where the central chamber 12 is uninflated and positioned beneath a supine person on a horizontal surface. As discussed above, the lateral chamber 14 is at least partially filled with a padding material 25, such as foam, that causes the lateral chamber to comfortably engage and support the person in a region laterally adjacent to the person's lumbar spine. The uninflated central chamber 12 is embedded in the foam. FIG. 4*b* is another front cross sectional view of the lumbar support pillow of FIG. 2*b*, where the central chamber 12 has been inflated to support the lumbar region of the supine patient.

Figure 5:
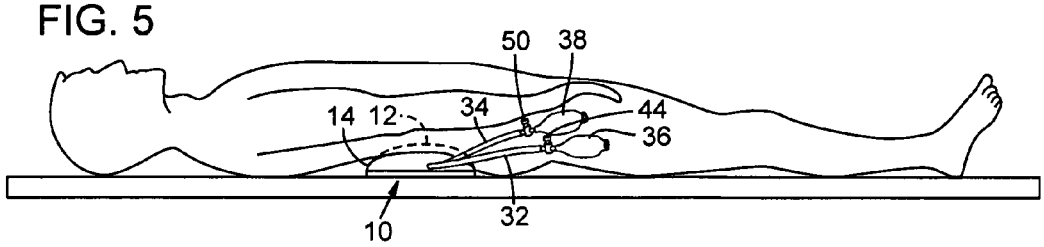
FIG. 5 is a side elevational view of the lumbar support pillow of FIG. 1, showing possible adjustment of the amount of fluid in the pillow.
Figure 6:
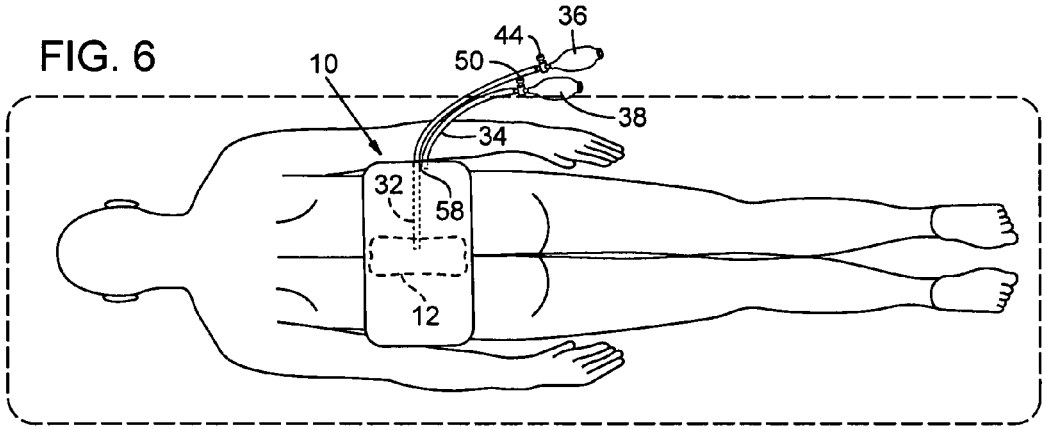
FIG. 6 is a bottom view of the lumbar support pillow of FIG. 2*a*, showing alignment of a central chamber of the pillow with the longitudinal axis of the person's spine.

FIG. 5 is a side elevational view of the lumbar support pillow of FIG. 1, showing possible adjustment of the amount of fluid in the pillow, and FIG. 6 is a bottom view of the lumbar support pillow of FIG. 1, showing alignment of a central chamber of the pillow with the longitudinal axis of the person's spine. As best may be seen in FIGS. 5 and 6, the lengths of tubes 32 and 34 may be chosen such that bulbs 36 and 38 may be proximally disposed in relation to one of a supine user's hands. Thus, a supine user may use the bulbs and/or egress valves 44 and 50 to adjust the amount of fluid in the back pillow. As depicted, one of the tubes may have a slightly greater length than the other, allowing a supine user to distinguish the tubes. This may allow the user to selectively fill chambers 12 and 14 independently, without unnecessary motion. In particular, a supine person may remain supine while adjusting the fluid levels in the chambers.

Figure 7:
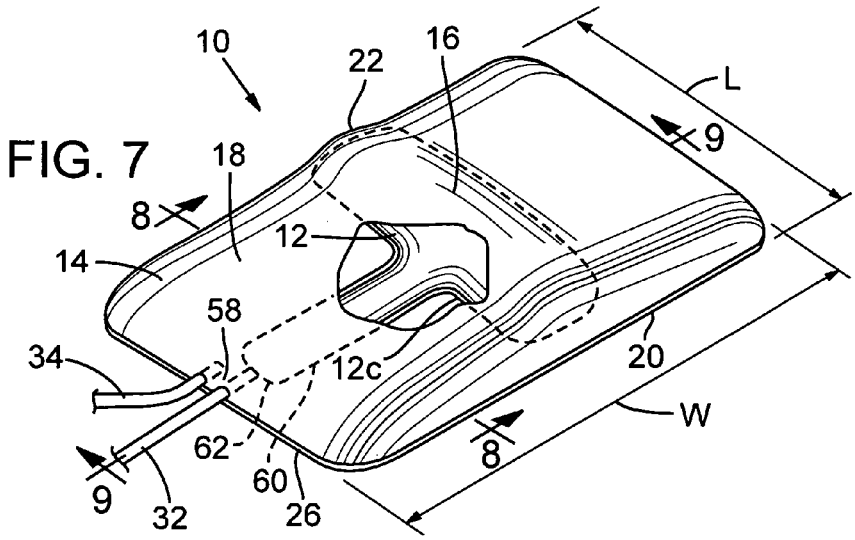
FIG. 7 is a perspective view of an embodiment of a lumbar support pillow.
Figure 8:
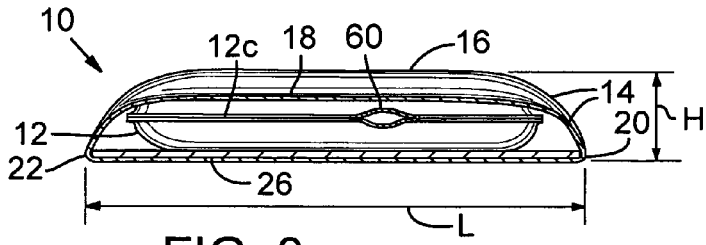
FIG. 8 is a side cross sectional view of an embodiment of the lumbar support pillow shown in FIG. 7, taken along lines 8-8.
Figure 9:
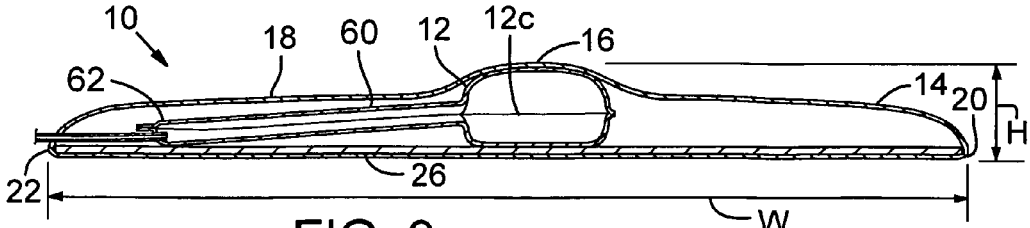
FIG. 9 is a front cross sectional view of the lumbar support pillow shown in FIG. 7, taken along lines 9-9.

In some embodiments, the fluid delivery mechanism may be modified to eliminate or reduce the amount of tubing disposed within the lumbar support pillow. For example, as shown in FIGS. 7-9, some embodiments of the support pillow 10 may have a fluid communication channel that includes a projection 60 that is integrally formed of the same material as the central chamber 12, extends laterally away from the central chamber to a distal end 62, and is configured to deliver fluid from a fluid source to the central chamber so as to define support surface 16. The distal end may be connected to a tube 32, which no longer extends all the way through the lateral chamber 14 to the central chamber. Because the projection 60 is integrally formed of the same material as the central chamber, it is less rigid than tube 32. Therefore, relative to the likelihood of feeling the tube 32 through the surface of the lateral chamber, a person is less likely to feel the projection through the surface 18 of lateral chamber 14 when using the support pillow. The projection may therefore provide added comfort for the user.

Figure 10:
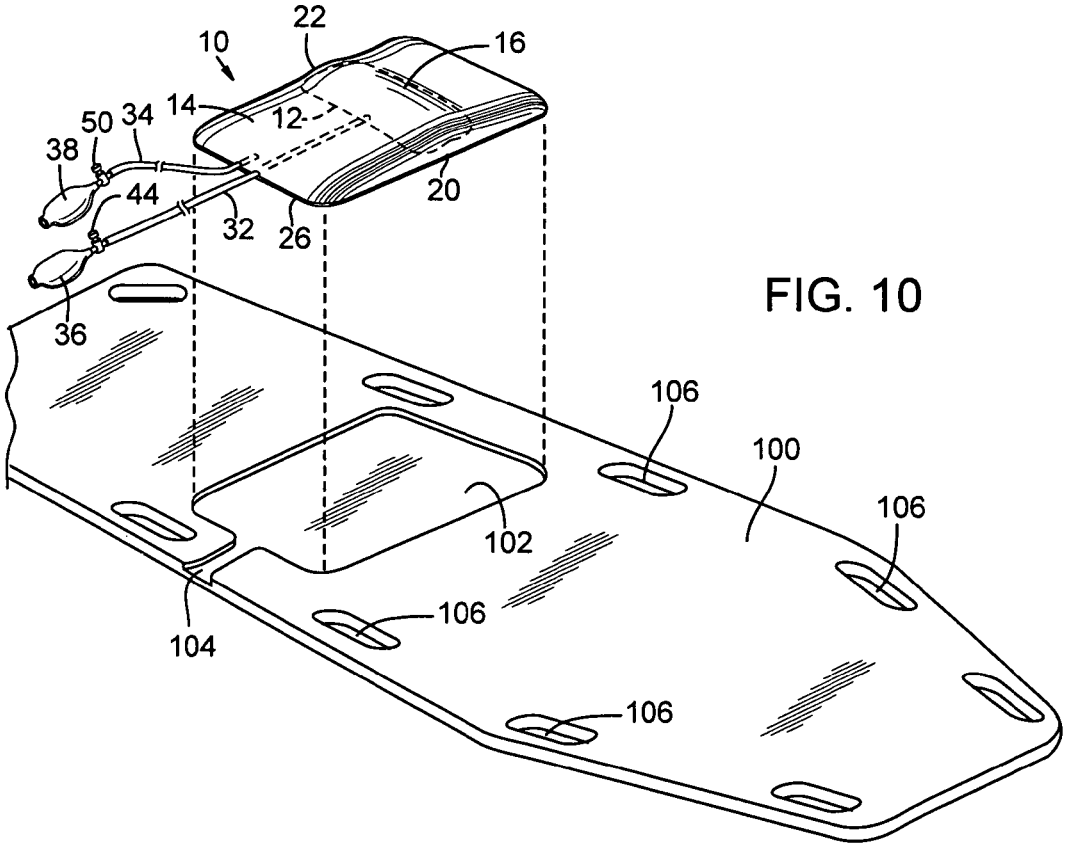
FIG. 10 is a perspective view of a lumbar support pillow and a medical backboard, showing positioning of the support pillow within a recess in the backboard according to an embodiment of the invention.

In some embodiments, it may be desirable to incorporate the lumbar support pillow of the present invention into a table, a chair, or any other object that includes a surface of contact for the lumbar spine. For example, FIG. 10 depicts lumbar support pillow 10 interfaced with an emergency medical backboard 100 such as might be used to transport victims from the scene of an accident (see also Example 2 below). Similarly, a lumbar support pillow according to the present invention might be provided as an integral part of any medical examining table such as an MRI table, a CT table, or an x-ray table, among others. Massage tables, automobile seats, reclining chairs, and wheelchairs represent further possible structures into which the lumbar support pillow may be integrally formed, according to aspects of the invention.

Figure 11B:
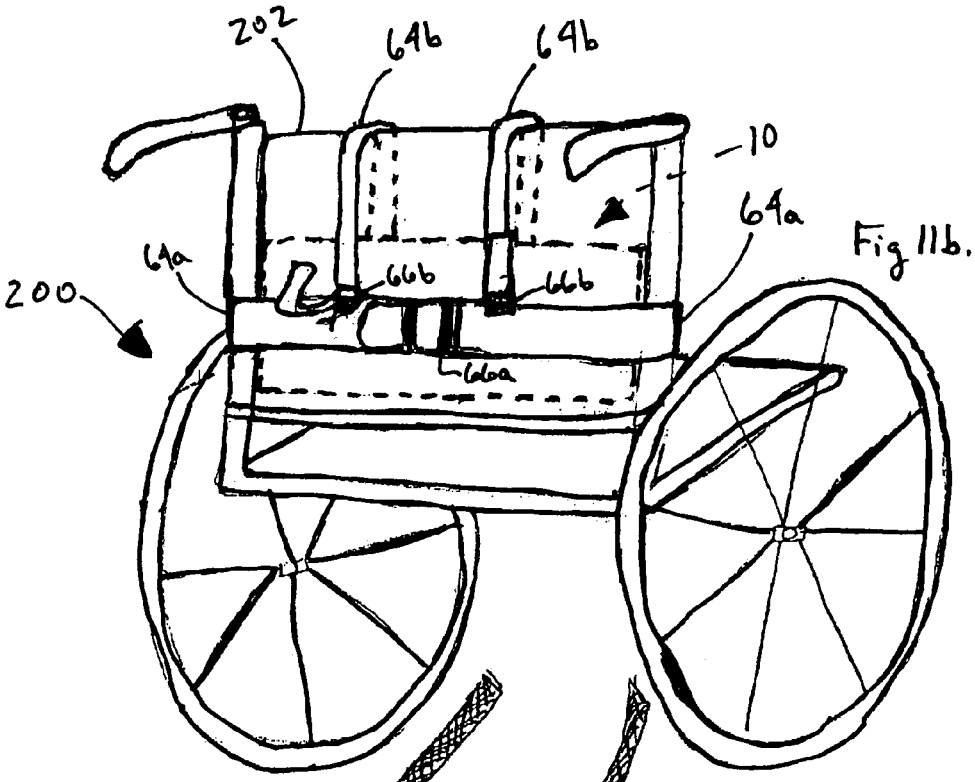
FIG. 11*b* is a rear view of the lumbar support pillow attached to the wheelchair of FIG. 11*a*.

The lumbar support pillow may also be configured with a securing device for selectively engaging massage tables, automobile seats, reclining chairs, wheelchairs, and other supporting devices. For example, as shown in FIGS. 11*a* and 11*b*, the lumbar support pillow 10 may include one or more straps, such as side straps 64*a*, and upper straps 64*b*, which enable a user to attach the support pillow to the back 202 of a wheel chair 200. In some embodiments, as shown in FIG. 11*a*, the straps 64*a* and 64*b* may be integrally attached to the seam of the lateral support 14. As shown in FIG. 11*b*, the straps may include one or more buckles, such as buckles 66*a* and 66*b*, or other attachment devices that enable the straps to securely attach to one another. For example, the side straps 64*a* that each wrap around the sides of the wheelchair's back 202, may engage each other at a buckle 66*a* that allows a user to tighten the straps around the wheelchair's back. Similarly, the upper straps 64*b* that loop over the top of the wheelchair's back may attach to straps 64*a* via buckle 66*b*, which allows a user to adjust the height of the support pillow 10 relative to the wheelchair's back 202. The shorter the length of the strap 64*b* between the support pillow 10 and the buckle 66*b*, the higher the support pillow is positioned relative to the wheelchair's back. Strap 64*b* may also have portions that include opposing sides of hook and loop fasteners, so that the strap can be secured back onto itself after the height of the support pillow has been properly adjusted. In some embodiments, the support pillow 10 may alternatively or additionally include hooks, clasps, cords or other devices that are either attachable or integral to the pillow, and that are configured to engage portions of a supporting device such as the back 202 of wheelchair 200.

Figure 14:
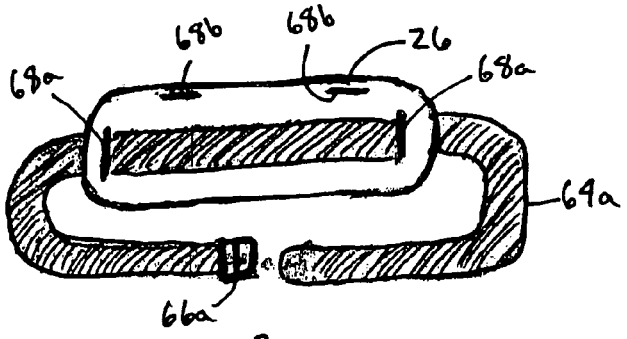
FIG. 14 is a perspective view of an embodiment of a strap for attaching a support pillow.
Figure 15:
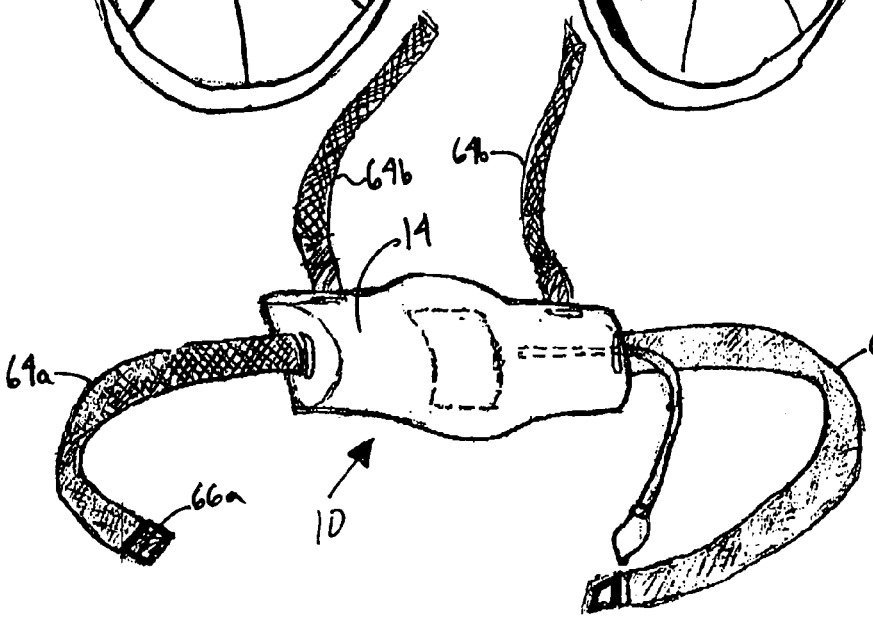
FIG. 15 is a perspective view of another embodiment of a strap for attaching a support pillow.

In some embodiments, such as those shown in FIGS. 14 and 15, the strap may attach to the support pillow's base. FIG. 14 shows a strap 64*a* passing through slits 68*a* in base 26. The base 26 may also include slits 68*b* for receiving other straps, such as the upper straps 64*b* shown in FIGS. 11*a* and 11*b*. As shown in FIG. 15, bases that have slits for receiving straps may be attached to either the bottom, or secured to the inside of lateral support 14. Attaching straps directly to the base, such as shown in FIGS. 14 and 15, provides a more secure mechanism for attaching support pillow 10 to a solid support, such as a wheelchair or other device.

In some embodiments, such as those shown in FIGS. 12 and 13, the lumbar support pillow may include a removable cover, such as a pillowcase 300, configured to cover the base member 26 and chambers 12 and 14. The cover may be tailored to the general size and shape of the support pillow, and variously sized covers may be provided for support pillows having various sizes. The cover may substantially enclose the fillable chambers and base member, and may have one side left open. The open side facilitates installation and removal of the cover, and allows any fluid delivery tubes to extend from the fillable chambers and out of the cover.

The cover may be constructed from materials that promote the comfort and ease of use of the support pillow. In some embodiments, such as the embodiment shown in FIGS. 12 and 13, the cover 300 may have an inner non-absorbent layer 302 and an outer absorbent layer 304. The non-absorbent inner layer 302 may be constructed form a plastic material that facilitates insertion and removal of the support pillow from the cover. The absorbent outer layer 304 may be configured to provide optimal comfort and to absorb sweat. In some embodiments (not shown), the cover may have a bottom constructed from a thin plastic material that facilitates sliding the support pillow behind or beneath a person's lumbar spine, and/or a top surface constructed from a soft, absorbent material.

FIG. 16-18 show a lumbar support pillow 10, where the central chamber 12 is not substantially enclosed by the lateral chamber, and where the lateral chamber 14 is segmented into two sides 14*a* and 14*b*. As shown, the central chamber 12 is separateable from the lateral chamber 14, and fits within a hole surrounded by the lateral chamber. Both the central chamber 12 and the lateral chamber 14 may be separately glued to a base 26. The segmented sides may or may not be in fluid communication with one another. In some embodiments, such as where the segmented sides are not in fluid communication with one another, each side may include its own separate fluid delivery mechanism (as described above).

FIG. 19 shows an embodiment of a base 26 having an oblong shape. This particular shape includes lobes 70 that may support a lumbar support pillow having a particular long central chamber. It should be appreciated, however, that in any particular embodiment, the base may be any shape so as to conform to the relative dimensions of the central and lateral chambers of any particular lumbar support pillow.

Generally, the components of the lumbar support pillow of the present invention may be constructed of any suitable materials or combinations of materials, such as those specifically noted above. It should be appreciated, however, that in some embodiments, particularly those used in medical facilities such as clinics and/or hospitals, it may be desirable to construct the support pillow from specific materials that have been approved by one or more regulatory agencies. For example, in the United States, it may be desirable to construct the support pillow from materials that have been approved by the Food and Drug Administration (FDA). Such FDA-approved materials may have undergone strict testing procedures to ensure their safety in clinical environments, and/or in emergency medical situations.

EXAMPLE 1

This example illustrates a possible method of use of the support pillow of the present invention in a clinical setting, where a patient is undergoing medical testing requiring them to maintain a horizontal supine position for a prolonged period of time.

Referring to FIGS. 3-6, any fillable chambers of support pillow 10 initially may be substantially empty, to simplify positioning the support pillow under a supine patient. A cover, as shown in FIGS. 12 and 13, may also be used to nominally enclose the support pillow, as described above. The support pillow is slid under the supine patient's torso, such that central chamber 12 is approximately aligned with the patient's lumbar spine. This alignment may be checked by inspection, and adjusted as necessary. The placement of the support pillow preferably may be accomplished with relatively little motion of the supine patient. Once the support pillow is positioned properly as described above, central chamber 12 and/or lateral chamber 14 (if fillable, such as in FIGS. 3*a* and 3*b*) are filled with fluid. This may be conveniently accomplished, for instance, by repeatedly squeezing bulbs 36 and/or 38, respectively, and/or by injecting fluid into a syringe port (such as syringe port 54 shown in FIG. 1), until the chamber(s) have been filled to a comfortable level. Note that bulb 36 and/or bulb 38 may have its distal end in fluid communication with a gas (such as air), a liquid (such as water), or a gel, amongst others, so that the fillable chambers may be selectively filled with any desired fluid. In some instances, it may be desirable to heat or cool the fluid before filling the chambers.

In some embodiments, the fluid delivery mechanism includes a pressure sensitive gauge (not shown) on the bulb associated with the central chamber. The gauge may be used by an attendant such as a nurse, to identify a safe pressure in the central chamber for patients who might have an existing spine injury. In this manner, for example, back surgery patients may be provided with a carefully monitored and safe amount of support to their lumbar spine, while being transported by backboard or stretcher to and/or from surgery.

Adjustments to the level of fluid in each fillable chamber are made through selective use of the fluid delivery system, such as bulbs 26 and/or 38, and egress valves 44 and/or 50. As shown, the bulbs and egress valves may be oriented to be within easy reach of the supine patient lying on the support pillow. Thus, the supine patient may independently adjust the fluid level of each chamber conveniently, and with relatively little motion. Slight adjustments over a period of time may increase the comfort level of the patient. Prior to removing the support pillow from under the supine patient's body, the fillable chambers may be partially or completely emptied using egress valves 44 and/or 50, so that the pillow may be removed easily and safely.

EXAMPLE 2

This example illustrates how the support pillow of the present invention may be used in conjunction with a medical backboard in an emergency situation.

As shown in FIG. 10, a rigid stretcher or medical backboard 100 is commonly used to immobilize and transport an injured person. Using backboard 100, the person may be transported to a medical facility, such as a hospital, without inducing additional injury or trauma to the person while moving them. Upon arrival at the hospital, the injured person may remain on the backboard for a substantial period of time, while waiting for medical attention and/or until medical tests indicate that it is safe to move the person off of the backboard. During the period of immobilization, the injured person may experience unnecessary pain and discomfort due to the hard and flat nature of the backboard to which they are attached.

Commonly, a blanket is placed on the backboard so that it will be positioned under the injured person, but the blanket may not maintain its position, and may not provide anatomically correct back support in any case. Padding may be provided as a permanent feature of the backboard, but this adds bulk and weight to the backboard, which may be undesirable in an emergency situation where time and space may be at a premium. Furthermore, such permanent padding may not be adjustable, so that it may not provide anatomically correct back support for patients of differing anatomies.

In one embodiment, the support pillow of the present invention may be slid under a person on a backboard in substantially the same manner as in a clinical setting, i.e. as described in Example 1. However, in another embodiment, the support pillow may be provided as an integral part of a backboard. For example, as depicted in FIG. 7, support pillow 10 may be installed in a shallow recess 102 in backboard 100, so that the top surface of the support pillow is substantially flush with the top of the backboard when the chambers of the support pillow are unfilled.

Recess 102 may be substantially centered across the width of backboard 100, and may be positioned in a region approximately coinciding with the lumbar region of a person disposed on the backboard. In some instances, the longitudinal position of the support pillow be adjustable with one or more handles, levers, or the like (not shown), so that the support pillow may be additionally aligned with the lumbar spine of a person lying on the backboard. A lateral portion 104 of recess 102 allows the pillow's tubes (such as tubes 32 and 34) to extend to the edge of backboard 100 without crimping the tubes. Typically, the backboard may include a number of apertures 106 and/or straps (not shown), to enable manually lifting and transporting the backboard. Lateral portion 104 may be positioned so as to minimize or eliminate interference with these apertures and/or straps.

The support pillow may be installed in the backboard with its chambers unfilled, so that its upper surface is substantially level, or flush, with the top surface of the backboard. In this manner, the presence of the support pillow may not inhibit placement of an injured person onto the backboard. However, upon a determination by an emergency attendant that it is safe and appropriate to do so, the support pillow may be inflated to a desired level in a manner described previously. This will often lead to increased comfort of the injured person during transport, and/or before they are removed from the backboard in a medical facility. Prior to removal of the person from the backboard, it may be desirable to deflate the fillable cushions, for example using egress valves 44 and 50, as already described.

EXAMPLE 3

This example illustrates how the support pillow of the present invention may be used in conjunction with a chair or wheelchair.

A wheelchair 200 is shown in FIG. 11 having a back 202. Wheelchairs are commonly used to transport an injured or disabled person. Many wheelchair users spend large portions of time seated in the wheelchair, oftentimes causing substantial back pain due to injury or improper posture.

It may therefore be desirable to attach the lumbar support pillow of the present invention to the back 202 of the wheelchair so that the central chamber 12 is positioned to engage the lumbar region of the person's spine along its longitudinal axis. For example, FIG. 11 depicts lumbar support pillow 10 attached to the back 202 of wheelchair 200 by strap 64. Any of the embodiments of support pillow described above may be used. The wheelchair user may then use the pillow's fluid delivery mechanism, as already described, to regulate the amount of support provided to their lumbar region by the pillow.

While the specific examples presented above represent typical methods of using the lumbar support pillow of the invention, the most general method of using the pillow to nominally maintain homeostasis of person's lumbar spine is much simpler. The method includes providing a lumbar support pillow according to the present invention in a location between a person's lumbar spine and a substantially flat surface, and at least partially filling the central chamber with fluid. In cases where the person is immobilized for any reason, providing the pillow may include sliding it between the flat surface and the person's lumbar region. An optional step is to also at least partially fill the lateral chamber with fluid.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

I claim:

1. A lumbar support pillow for supporting the lumbar spine of a person, comprising:

a fillable elongate first chamber longitudinally configured to engage and support the person along the longitudinal axis of the person's lumbar spine in a manner substantially conforming to the natural curvature of the spine when at least partially filled; and a second chamber that extends downwardly and away from the first chamber on both sides of the first chamber, is independent of the first chamber, and is configured to engage and support the person in a region laterally adjacent to the person's lumbar spine;

wherein the pillow includes an arcuate support surface having height that varies symmetrically alone its length.

2. The lumbar support pillow of claim 1, wherein the second chamber is substantially filled with foam.

3. The lumbar support pillow of claim 2, wherein the first chamber is substantially enclosed by the second chamber.

4. The lumbar support pillow of claim 3, wherein the first chamber is substantially embedded within the foam.

5. The lumbar support pillow of claim 1, further including a rigid base member configured to support the first and second chambers and having a substantially flat bottom.

6. The lumbar support pillow of claim 5, wherein the base member is configured to slide between a person and a substantially flat surface with minimal friction between the base member and the substantially flat surface.

7. The lumbar support pillow of claim 5, wherein the base member is constructed from a thermoplastic polymer material.

8. The lumbar support pillow of claim 5, wherein the base member is substantially enclosed by the second chamber.

9. The lumbar support pillow of claim 1, further comprising a fluid delivery mechanism including a first fluid communication channel configured to deliver fluid from a fluid source to the first chamber.

10. The lumbar support pillow of claim 9, wherein the first chamber is substantially enclosed by the second chamber.

11. The lumbar support pillow of claim 9, wherein the first fluid communication channel includes a projection that is integrally formed of the same material as the first chamber, extends laterally away from the first chamber to a distal end, and is configured to deliver fluid from a fluid source to the first chamber.

12. The lumbar support pillow of claim 11, wherein the first fluid communication channel further includes a tube configured to deliver fluid from a fluid source to the distal end of the projection.

13. The lumbar support pillow of claim 9, wherein the second chamber is fillable, and the fluid delivery mechanism includes a second fluid communication channel configured to deliver fluid from a fluid source to the second chamber.

14. The lumbar support pillow of claim 13, wherein the first fluid communication channel includes a first tube configured to deliver fluid to the first chamber, and the second fluid communication channel includes a second tube configured to deliver fluid to the second chamber.

15. The lumbar support pillow of claim 14, wherein the fluid delivery mechanism includes, a first bulb configured to selectively deliver fluid into the first tube, a second bulb configured to selectively deliver fluid into the second tube, and at least one valve configured to selectively permit egress of fluid from the fillable chambers.

16. The lumbar support pillow of claim 14, wherein the fluid delivery mechanism includes a syringe port configured to receive fluid from a syringe, and a stopcock mechanism configured to selectively allow passage of fluid between the syringe and the first chamber.

17. The lumbar support pillow of claim 1, further comprising a strap for selectively attaching the lumbar support pillow to a structure.

18. The lumbar support pillow of claim 1, further comprising a removable cover having an inner non-absorbent layer and an outer absorbent layer.

19. The lumbar support pillow of claim 18, wherein the inner layer is constructed from a plastic material that facilitates removal of the cover.

20. A lumbar support pillow for supporting the lumbar spine of a person, comprising:

a fillable elongate first chamber configured to engage and support the person along the longitudinal axis of the person's lumbar spine in a manner substantially conforming to the natural curvature of the lumbar spine when:

the first chamber is positioned adjacent to the lumbar spine;

the chamber's longitudinal axis is oriented to be substantially parallel to the longitudinal axis of the lumbar spine; and the first chamber is at least partially filled;

a second chamber independent of the first chamber, extending downwardly and away from the first chamber on both sides of the first chamber, and configured to engage and support the person in a region laterally adjacent to the person's lumbar spine;

wherein the pillow includes an arcuate support surface having height that varies symmetrically along its length.

21. A method of nominally maintaining homeostasis of a person's lumbar spine, comprising:

providing a lumbar support pillow includes an arcuate support surface having height that varies symmetrically along its length in a region between the person's lumbar spine and a substantially flat surface, the pillow including:

a fillable elongate first chamber configured to engage and support the person along the longitudinal axis of the person's lumbar spine in a manner substantially conforming to the natural curvature of the spine when at least partially filled; and a second chamber that extends downwardly and away from the first chamber on both sides of the first chamber, is independent of the first chamber, and is configured to engage and support a person in a region laterally adjacent to the person's lumbar spine; and filling the first chamber at least partially with fluid.

* * * * *